United States Patent [19]

LaFever et al.

[11] 4,197,801

[45] Apr. 15, 1980

[54] AMMUNITION ROUND

[75] Inventors: Clifford E. LaFever, Mission Viejo; William J. Washburn, Capistrano Beach, both of Calif.

[73] Assignee: Ford Aerospace & Communications Corporation, Newport Beach, Calif.

[21] Appl. No.: 894,305

[22] Filed: Apr. 7, 1978

[51] Int. Cl.[2] ..... F42B 5/02

[52] U.S. Cl. ..... 102/38 CC; 102/40; 102/45

[58] Field of Search ..... 102/38 R, 38 CC, 45, 102/40

[56] References Cited

U.S. PATENT DOCUMENTS

| | | | |
|---|---|---|---|
| 219,107 | 9/1879 | Merriam | 102/40 |
| 390,232 | 10/1888 | Hurst | 102/40 |
| 562,535 | 6/1896 | Hurst | 102/40 |
| 2,866,412 | 12/1958 | Meyer et al. | 102/40 X |
| 3,613,587 | 10/1971 | King | 102/40 |
| 3,626,851 | 12/1971 | Ruth | 102/40 |
| 3,688,698 | 9/1972 | Quinlan | 102/40 |
| 3,892,181 | 7/1975 | Goldin | 102/40 |

FOREIGN PATENT DOCUMENTS

| | | | |
|---|---|---|---|
| 1069134 | 7/1954 | France | 102/45 |

*Primary Examiner*—Harold J. Tudor
*Attorney, Agent, or Firm*—Peter Abolins; Clifford L. Sadler

[57] ABSTRACT

This specification discloses an ammunition round and a method of firing the ammunition round. Consecutive and reproducible firing of a primer charge and a main propellant charge is accomplished as a result of the physical movement of a divider physically separating the primer charge from the main charge. Firing of the primer charge causes movement of the divider, initiates movement of a projectile within the ammunition round, and, when the combustion gases of the primer charge are in communication with the main propellant charge, causes firing of the main propellant charge.

8 Claims, 3 Drawing Figures

AMMUNITION ROUND

BACKGROUND OF THE INVENTION

1. Field of the Invention

This invention relates to an apparatus and method for improving the ballistic performance of ammunition round, and, more particularly, the firing sequence of a projectile from an ammunition round.

2. Description of the Prior Art

Telescoped caseless ammunition is comprised of a propellant charge having an axial bore or cavity, a projectile housed entirely within the axial bore of the propellant charge and a primer positioned aft of the projectile. When a telescoped round of caseless ammunition is loaded into the chamber of a gun, the projectile, being housed in a propellant charge, is not seated in the barrel of the gun as is the projectile of a round of conventional ammunition when in a gun chamber. Upon initiation of the primer of the telescoped round, the projectile is forced forward into a barrel of the gun and becomes seated in the barrel. During the time interval from initiation of the primer until the projectile is seated in the barrel of the gun, some of the gases of combustion from the primer and from the initiated propellant charge can escape through the barrel ahead of the projectile resulting in a loss of impetus. Although telescoped ammunition is more convenient to handle than conventional ammunition, it presents different, and often more difficult, design and firing problems.

The primer must perform the dual function of first launching the projectile and then causing the main propellant charge to ignite. If the ignition of the main charge occurs too early, much of the work generated by the burning main propellant charge is lost to gases which escape down the barrel before the projectile obturates the barrel entrance. Should ignition of the main propellant charge be delayed, projectile travel causes the free volume of the chamber to be effectively increased beyond a desired optimum and reduce impetus to the projectile. Therefore, the primer must be formed in a precise, highly reproducible fashion to achieve good performance with telescoped ammunition.

Previous attempts at controlling the ignition and the firing sequence of a telescoped ammunition round have involved the use of adjusting the burning rates or chemical properties of the explosive or propellant materials. For example, it is known to use a gas barrier which separates the propellant charge into a forward section and an aft section. The chemical composition of the gas barrier is such that it momentarily delays flow of hot combustion gas to the forward section of the propellant charge, thereby delaying the ignition of the forward section with respect to the aft section.

However, relying upon the chemical properties of a material makes manufacturing more difficult and expensive because such chemical properties must be accurately controlled to provide performance of the ammunition round within desired limits. Indeed, depending upon the reproducibility required, manufacturing of such ammunition rounds can become an undesirably critical process. Further, it is difficult to develop materials which can cause firing of an ammunition round within a desired time limit under varying temperature conditions. As is known, ambient temperature affects the speed of burning and other chemical reactions. Since ammunition may be required to perform under conditions varying from Arctic cold to desert heat, suitable reliability in chemically controlling an ignition sequence for a telescoped ammunition round has been difficult to achieve. These are some of the problems the invention overcomes.

SUMMARY OF THE INVENTION

This invention teaches using mechanical, rather than chemical, action to control the firing sequence of a telescoped ammunition round. As a result, there is a high degree of reproducibility of firing action over a broad range of temperatures. Further, the criticality of exactly reproducing the chemical composition of the propellants from batch to batch is reduced thus simplifying manufacture and reducing the cost of manufacture.

In accordance with an embodiment of this invention, a propellant charge means for supplying firing power for an ammunition round has an axial cavity wherein a control tube means selectively covers portions of the propellant charge means facing the axial cavity thereby putting a selected portion of the propellant charge in communication with the axial cavity through a firing opening. A projectile means is housed within the axial cavity and can be fired from the ammunition round. A primer means is positioned generally aft of the projectile means and provides a firing force as part of a firing sequence for firing the projectile means from the ammunition round. Sealing means provide a movable barrier between the primer means and the propellant charge means. The sealing means is positionable between a first condition separating the primer means and the propellant means, thus preventing ignition of the propellant means by the primer means, and a second condition permitting communication between the propellant means and the primer means through the firing opening thus permitting ignition of the propellant means by said primer means.

For example, the sealing means can include a piston which is movable, as a result of the firing of the primer means from a position blocking the firing opening through the control tube means to a position forward of the firing opening thus permitting communication from the primer means to the propellant means.

DETAILED DESCRIPTION OF THE INVENTION

Figure 1:
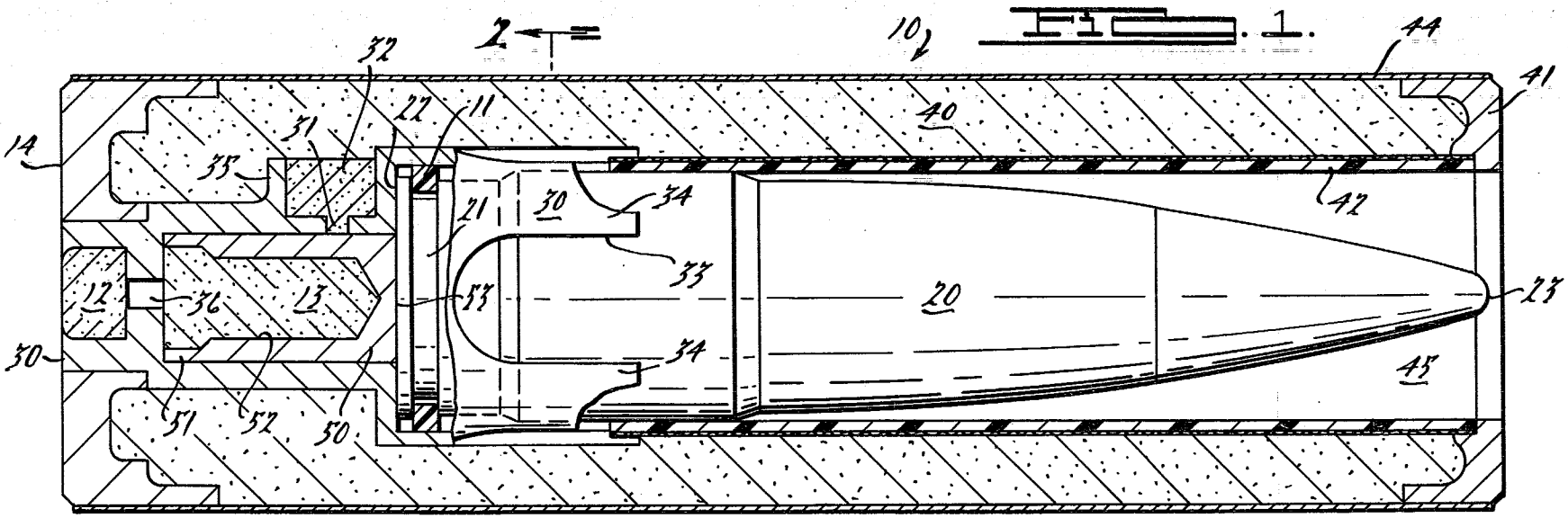
FIG. 1 is a longitudinal, partly sectional view of an ammunition round in accordance with an embodiment of this invention.

Referring to FIG. 1, an ammunition cartridge 10 includes a generally cylindrical main propellant charge 40 having a cylindrical, coaxial cavity 45 wherein is positioned a generally elongated, tapered projectile 20. Positioned aft of projectile 20 is a generally cylindrical piston 50 having a longitudinal axis aligned with the longitudinal axis of axial cavity 45. A rear access 52 is a recess in the aft face of piston 50 and contains a booster charge 13 for propelling piston 50 forward within axial cavity 45 which also causes corresponding forward motion of projectile 20 within axial cavity 45. A primer charge 12 is positioned aft of booster charge 13 and is fired to cause firing of booster charge 13. Control tube 30 is a generally cylindrical, hollow sheath which surrounds primer charge 12, booster charge 13 and a rearward portion of projectile 20. Control tube 30 is sized to fit snuggedly within axial cavity 45 of main propellant charge 40 and has four circumferentially spaced firing openings 31 adjacent to and closed by the outside surface of piston 50. Firing of primer charge 12 and booster charge 13 causes piston 50 to move forward of firing openings 31 and expose main propellant charge 40 to firing through firing openings 31.

This concept achieves performance repeatability in telescoped ammunition by physically separating the initial projectile acceleration and main propellant ignition function. Control tube 30 launches and guides projectile 20 toward the barrel of a firing gun and contains and confines the initial firing of primer charge 12 and booster charge 13 so that the start of the firing sequence occurs at a fixed volume thus increasing the impetus to projectile 20. After initial projectile acceleration, the ignition of main propellant charge 40 occurs through firing openings 31 when piston 50 has moved sufficiently forward within axial cavity 45 and firing openings 31 are in communication with axial cavity 45. Thus, main propellant charge 40 fires solely as a function of the forward travel position of piston 50. If desired, ignition of main charge 40 can be achieved by positioning an igniter charge 32 between main propellant charge 40 and piston 50 at firing openings 31. Igniter charge 32 provides a positive ignition of main propellant charge 40 in response to sufficient forward travel of projectile 20 and piston 50 within axial cavity 45.

Figure 2:
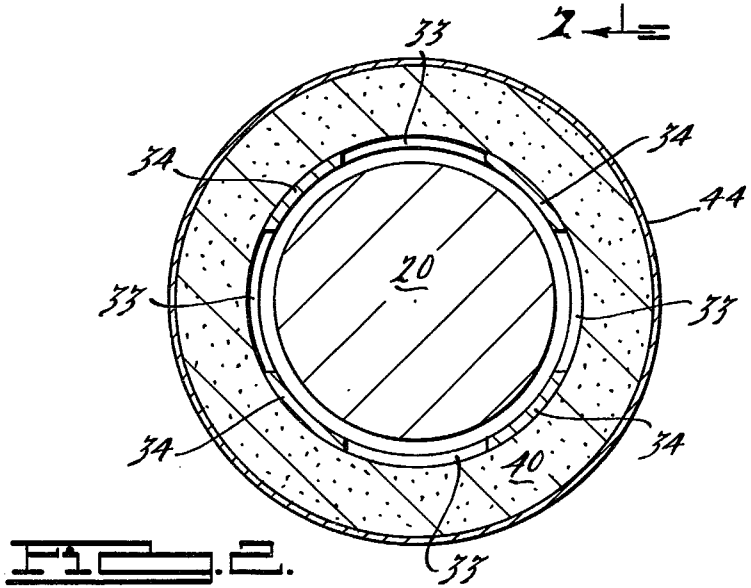
FIG. 2 is a sectional view taken along section line 2—2 of FIG. 1.

Control tube 30 has four circumferentially spaced slots 33 extending aft from the forward most portion of control tube 30 to a position forward of the rear end of projectile 20. As a result, the forward portion of control tube 30 includes forwardly projecting fingers 34 bounded on each side by slots 33 (see FIGS. 1 and 2). Slots 33 are located in the wall of control tube 30 to minimize the pressure differential on the wall between main propellant charge 40 and booster charge 13 resulting from rapid pressurization of the main charge. Too great a pressure differential would cause control tube 30 to collapse and impede firing. For example, a typical steel control tube will start to buckle if the pressure differential exceeds about 4000 psi. An aluminum tube with the same geometry will collapse at around 1400 psi. A typical length of each of four slots 32 is about 0.75 inches. Another approach would be to fabricate the control tube from a frangible, combustible material. The material would have to be strong enough to support the projectile during boost and contain the main charge during initial ignition phase to assure repeatable and minimum ignition delay. Nevertheless, firing of main propellant charge 40 is done through firing openings 31 when openings 31 are unported by movement of piston 50, and is not controlled by the combustion of the control tube.

Aft of projectile 20, the interior opening of control tube 30 narrows to the diameter of piston 50 to provide a snug fit between control tube 30 and piston 50. This is desirable to prevent forward leakage of combustion gases. Radially outwardly extending flanges 35 from an exterior portion of control tube 30 adjacent firing openings 31 define a recess wherein igniter charge 32 is contained. The inner diameter of control tube 30 further narrows aft of piston 50 to provide a channel 36 connecting primer charge 12 to booster charge 13 so that booster charge 13 can be fired as a result of control tube 30 increases to provide a cavity for receiving primer charge 12.

Piston 50 is generally cylindrical with a flat forward face 53 which abuts against a flat rear face 22 of projectile 20. Rear recess 52 opens to the rear of piston 50 and extends axially forward within piston 50 toward forward face 53. Booster charge 13 is positioned within recess 52, but can also extend aft of piston 50. The rearmost portion of rear recess 52 has a slightly larger diameter than the forward most portion of recess 52 so that the rearmost wall portion of piston 50 is somewhat thinner and can form a skirt 51, which is forced radially outward when booster charge 13 fires thus sealing the outer wall of piston 50 against the inner wall of control tube 30 and preventing forward leakage of firing gases. The piston can be of many forms such as of a combustible material, of a plastic material, integral with projectile 20, or a separate component from projectile 20.

Projectile 20 is generally cylindrical with a tapered front tip 23 for improved aerodynamic performance. The rearward portion of projectile 20 has an outer diameter which snuggly fits within an inner diameter of control tube 30. To further secure projetile 20 within control tube 30, the rear portion of projectile 20 includes a circumferential groove 21 wherein is positioned a split ring retainer ring 11 which compresses upon insertion into control tube 30 and provides an outwardly biased force to provide a retaining force preventing projectile 20 from slipping within control tube 30. If desired, control tube 30 can have a circumferential, inwardly facing groove to receive retainer ring 11 thus providing an additional force securing projectile 20 within control tube 30. Retainer ring 11 is advantageously fabricated of a material which shears upon application at a predetermined force.

Main propellant charge 40 is bounded by a cylindrical hollow outer case 44 on the outside cylindrical surface and an inner case 42 on the inside cylindrical surface around a forward portion of axial cavity 45. Inner case 42 extends from the front of main propellant charge 40 aft along a portion of the length of fingers 34. The aft end of main propellant charge 40 between the control tube 30 and outer case 44 is sealed by a generally annular base 14. Similarly, the forward end of main propellant charge 40 between inner case 42 and outer case 44 is closed by a generally annular front seal 41. An aft portion of main propellant charge 40 is in communication with igniter charge 32.

Although piston 50 can be integral with projectile 20, having a separate piston and projectile facilitates the manufacture and positioning of piston 50 thus minimizing the effect of free volume variability. When designing the transverse cross section size of piston 50, it is desirable to keep it sufficient small so there is a reduction in the piston velocity at ignition and a reduction in the potential for volume variability should some ignition delay occur.

OPERATION

The firing sequence of ammunition cartridge 10 includes the firing of primer charge 12 by such means as a firing pin or an electric spark so that heat and shock waves are transmitted along channel 36 to booster charge 13 which then ignites. The sequential firing of primer charge 12 and booster charge 13 causes a pressure build up aft of piston 50. At a predetermined pressure retainer ring 11 is sheared and there is forward movement of piston 50 in a direction parallel to the axis of axial cavity 45 as guided by control tube 30. As a result of such forward movement of piston 50 there is also forward movement of projectile 20. The volume containing the combustion gases from primer charge 12 and booster charge 13 is well controlled by the action of skirt 51 sealing the volume so that hot gases do not escape forward between the outer wall of piston 50 and the inner wall of control tube 30.

After piston 50 has sufficient forward displacement so that skirt 51 is positioned forward of firing openings 31, igniter charge 32 is exposed to hot combustion gases through firing openings 31 and itself fires. For example, 0.650 inches is a typical displacement for piston 50 to expose igniter charge 32 to the flame temperature of the firing of booster charge 13. The firing sequence of ammunition cartridge 10 continues by the firing of main propellant charge 40 as a result of the firing of ignition charge 32. If there is no igniter charge 32, main propellant charge 40 fires when firing opening 31 are unported and communicate combustion gases to main propellant charge 40. Projectile 20 has a typical speed of about 175 feet per second when igniter charge 32 activates main propellant charge 40.

Projectile 20 leaves ammunition cartridge 10, it enters the barrel of a firing gun and there is a snug fit, well known in the art, between the outer surface of the projectile and the inner surface of the barrel so that the hot combustion gases cause by the firing of ammunition cartridge 10 further propel projectile 20 out of the barrel. This staged sequence of ignition provides an energetic, fast and reproducible ignition of main propellant charge 40 controlled by the precise positioning of the projectile during the initial boost phase.

Figure 3:
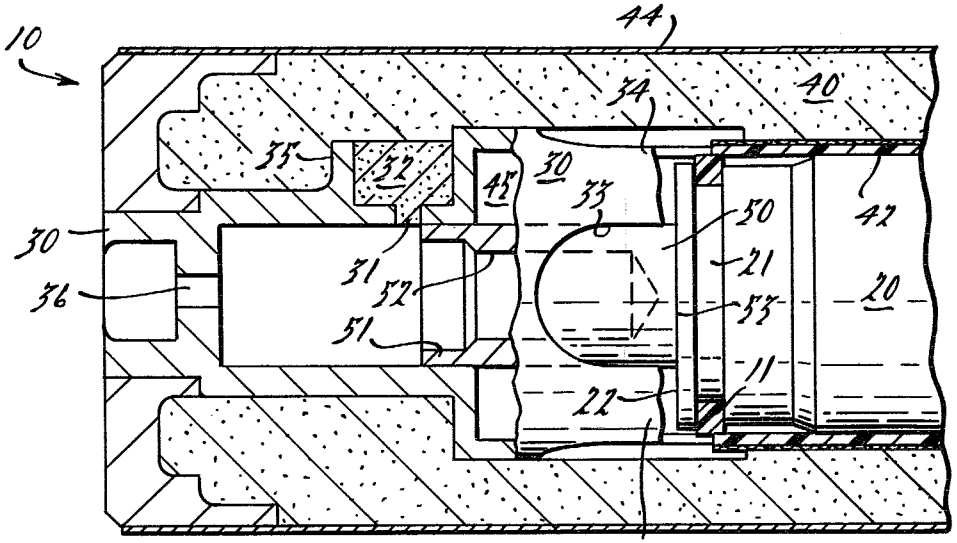
FIG. 3 is a view of the aft portion of the ammunition round of FIG. 1 after the firing sequence has begun and the piston has been moved forward sufficiently to permit communication between a main propellant charge and a primer charge.

Referring to FIG. 3, piston 50 as shown after firing of primer charge 12 and booster charge 13 and having moved forward sufficiently so that skirt 51 is forward of firing opening 31 and firing opening 31 is exposed to the hot combustion gases within the axial cavity 45 aft of piston 50. Projectile 20 has also moved forward the same distance that piston 50 has moved forward. Retainer ring 11 has remained positioned in groove 21 of projectile 20 and has been freed of engagement with control tube 30. Skirt 51 remains in contact with the inner surface of control tube 30 so that the combustion gases from the firing of primer charge 12 and booster charge 13 do not go into the vacated volume of axial cavity 45 aft of projectile 20. If this were to happen, the propelling force due to the firing of primer charge 12 and booster charge 13 would be diminished.

In accordance with an embodiment of this invention, projectile 20 can, for example, weigh 194.5 grams and have a diameter of 25 millimeters. In an embodiment including a separate piston 50, the booster charge 13 can be, for example, 1.23 grams black powder, the location of firing openings 31 can be 0.75 inch from the aft end of cartridge 10, piston 50 can have a diameter of about 0.375 to 0.50 inches and a length of about 0.65 inches, igniter charge 32 can be about 1.17 grams black powder and main charge 40 can be 50 grams CIL 5554 and 60 grams IMR 4350. When a separate piston 50 is not used, a typical charge for booster charge 13 is 1.23 grams black powder with firing openings 31 being located 0.5 inches from the rear end of ammunition cartridge 10, and the main charge being about, for example, 115 grams CIL 1391A. A typical material for inner case 42 is a canvas backed phenolic tube with a wall thickness of about 0.05. Outer tube 44 can have an outer diameter of about 1.755 inches and a length of 6.0 inches. Stainless steel is a typical material for outer case 44 and can have a wall thickness of about 0.02 inches. The control tube 30, base 14 and front seal 41 can be 17-4 stainless steel heat treated R "C" 42.

Various modifications and variations will no doubt occur to those skilled in the various arts to which this invention pertains. For example, the particular overlap of the control tube with the projectile may be varied from that disclosed herein. Similarly, the particular size and shape of the piston may be varied from that disclosed herein. These and all other variations which basically rely on the teachings through which this disclosure has advanced the art are properly considered in the scope of this invention.

We claim:

1. A fully telescoped ammunition round comprising:

a propellant charge means having an axial cavity for supplying firing power for said ammunition round;

a projectile means housed within said cavity for being fired from said ammunition round;

a control tube means for selectively covering portions of said propellant charge means facing said axial cavity thereby putting selected portions of said propellant charge in communication with said axial cavity and being generally positioned between said propellant charge means and said projectile means, said projectile means extending forward of said control tube means and including coupling means for releasably securing said projectile means to said control tube means;

a primer means positioned generally aft of said projectile means for providing a firing force as part of a firing sequence from said ammunition round;

said control tube means including a first firing opening for providing an access to said propellant charge means from said axial cavity so that temperature and pressure conditions within said axial cavity adjacent said first firing opening can act on said propellant means thus providing for firing of said propellant charge means;

said first firing opening being positioned intermediate the axial ends of said control tube means;

said control tube means having a second firing opening circumferentially displaced from said first firing opening;

said control tube means including slotted means forward of said first firing opening for providing a communication path between said propellant charge and said axial cavity for reducing the pressure differential across said control tube means when said propellant charge is fired;

sealing means for separating said axial cavity into a forward portion and aft portion, said sealing means being conditionable between a first condition separating said primer means and said first firing opening thus providing a barrier between said primer means and said propellant means and a second condition permitting communication between said propellent means and said primer means through said firing opening;

said sealing means including a piston means positioned aft of said projectile means so that forward motion of said piston means within said axial cavity causes forward motion of said projectile means within said cavity; and said piston means having a generally cylindrical outer shape, a rearwardly opening recess means for receiving a charge and a skirt means extending circumferentially around said piston means for obstructing the flow of combustion gases between said piston means and said control tube means.

2. An ammunition round as recited in claim 1 wherein said piston means and said projectile means are integral.

3. An ammunition round as recited in claim 1 wherein said primer means includes a primer charge positioned aft of said piston means and a booster charge positioned within said rearwardly opening recess, said primer and booster charges being sufficiently close together so that ignition of said primer charge causes ignition of said booster charge and causes a forward movement of said piston means within said axial cavity and thus forward movement of said projectile means within said axial cavity.

4. An ammunition round as recited in claim 1 wherein said sealing means and said projectile means are integral, said first firing opening is forward of the aft end of said projectile means and forward motion of said projectile means is necessary to put said propellant charge means in communication with said primer means through said first firing opening thus permitting sequential ignition of said propellant charge means and said primer means as a function of the physical position of said projectile means within said axial cavity.

5. An ammunition round as recited in claim 1 wherein said first firing opening is forward of the aft end of said piston means and forward motion of said piston means is necessary to put said propellant charge means in communication with said primer means through said first firing opening thus permitting sequential ignition of said propellant charge means and said primer means as a function of the physical position of said piston means within said axial cavity.

6. An ammunition round as recited in claim 5 further comprising an igniter charge positioned adjacent said propellant charge means at said first firing opening, said igniter charge providing for the firing of said propellant charge means.

7. An ammunition round as recited in claim 5 wherein said control tube means is sufficiently axially elongated so that it can circumferentially surround, in a direction transverse to the longitudinal axis of said axial cavity, said primer means, said piston means and only a portion of said projectile means.

8. A fully telescoped ammunition round comprising:

a propellant charge having an axial cavity for supplying firing power for said ammunition round;

a projectile means housed within said cavity for being fired from said ammunition round, said projectile means being elongated in a direction along the axis of said axial cavity;

a primer means positioned generally aft of said projectile means for providing a firing force as part of a firing sequence for firing said projectile means from said ammunition round;

a piston means positioned aft of said projectile means so that forward motion of said piston means within said axial cavity causes forward motion of said projectile means within said axial cavity and said piston means includes a circumferential, radially extending skirt thereby providing a seal isolating the portion of said axial cavity forward of said skirt from the portion of said axial cavity aft of said skirt, said skirt acting as a seal so a force caused by firing of said primer means is transferred to said piston means thus causing forward motion, and said piston means further including a rearwardly opening recess so that said skirt generally surrounds the periphery of said recess;

a primer charge portion of said primer means being positioned aft of said piston means and a booster charge portion of said primer means being positioned within said recess and being positioned sufficiently close so that firing of said primer charge portion causes firing of said booster charge portion and results in forward motion of said piston means and projectile means;

a control tube means positioned within said axial cavity and laterally surrounding said primer means and said piston means thereby directing a force from the firing of said primer means along the axis of said axial cavity, said control tube means having a first firing opening extending radially through the wall of said control tube means thereby providing a path of communication between said axial cavity and said propellant charge, said first firing opening being positioned forward of said skirt so that said first firing opening is initially isolated from said primer means by said piston means and is in communication with said primer means after firing of said primer means and movement of said skirt forward of said first firing opening thus causing firing of said piston means along said axial cavity, and said first firing opening being positioned intermediate the axial ends of said control tube means;

said control tube means having a second firing opening circumferentially displaced from said first firing opening, said control tube means extending forward over at least a portion of said projectile means and further including coupling means for releasably securing said projectile means to said control tube means;

said coupling means includes an inwardly facing circumferential groove within said control tube means, an outwardly facing circumferential groove around said projectile means, said grooves positioned to be aligned when said control tube means and said projectile means are in said ammunition round, and a retainer ring adapted to be positioned within said inwardly and outwardly facing grooves and to shear in response to a predetermined pressure applied to said projectile means thereby releasably securing said projectile means and said control tube means to each other;

said control tube means including slotted means forward of said first firing opening for providing a communication path between said propellant charge and said axial cavity and for reducing the pressure differential across said control tube means when said propellant charge is fired; and said control tube means and said piston means being fabricated of a combustibly consumable material having sufficient initial resistance to combustion so that said primer means is isolated from the propellant charge for a period of time after firing of said primer means and so that the piston means can physically cause movement of the projectile means.

* * * * *